United States Patent [19]

Förster et al.

[11] 4,109,574

[45] Aug. 29, 1978

[54] CONTROL SYSTEM FOR POSITIONING UNITS EXHIBITING DEAD TIMES

[75] Inventors: Karl-Heinz Förster, Dresden; Werner Lein; Hartmut Heiber, both of Radebeul, all of German Democratic Rep.

[73] Assignee: Veb Polygraph Leipzig Kombinat fur Polygraphische Maschinen und Ausrustungen, Leipzig, German Democratic Rep.

[21] Appl. No.: 782,541

[22] Filed: Mar. 29, 1977

[30] Foreign Application Priority Data

Mar. 29, 1976 [DD] German Democratic Rep. ... 192087

[51] Int. Cl.[2] ..... B41F 13/00; B41F 33/16

[52] U.S. Cl. ..... 101/216; 101/247; 101/183

[58] Field of Search ..... 101/181–185, 101/136, 137, 232, 236, 141, 238, 239, 247, 212, 216

[56] References Cited

U.S. PATENT DOCUMENTS 3,818,827 6/1974 Johne et al. ..... 101/232

3,946,669 3/1976 Johne et al. ..... 101/183

*Primary Examiner*—J. Reed Fisher

*Attorney, Agent, or Firm*—Michael J. Striker

[57] ABSTRACT

The printing cylinders or other functional units of a printing machine are engaged and disengaged by positioning units. When a positioning unit receives an activating signal, its response thereto includes a dead time or delay time. Because the activation of the positioning units proceeds in dependence upon the angular position of a rotary reference component of the printing machine, and all operations are synchronized in terms of angular positions and angular spans, the dead time of the positioning units, when expressed in angular units, is a function of the operating speed of the printing machine. If the operating speed is variable, proper angular synchronization tends to be lost. The invention includes a clocked control unit clocked in angular synchronism with machine operation and determining when positioning units are to be activated and time-delay stages which introduce compensatory time delays into the application of activating signals to the positioning units. The compensatory time delays are automatically varied as a function of machine operating speed.

7 Claims, 4 Drawing Figures

FIG. 2
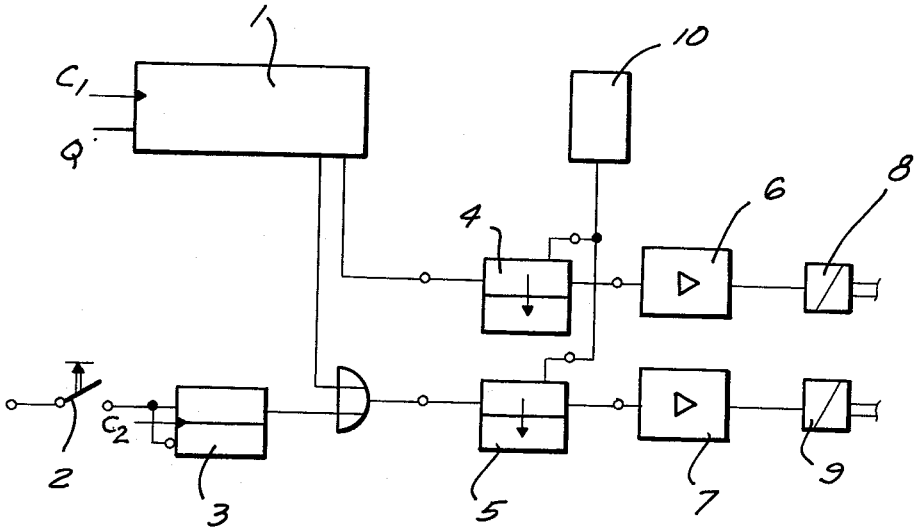
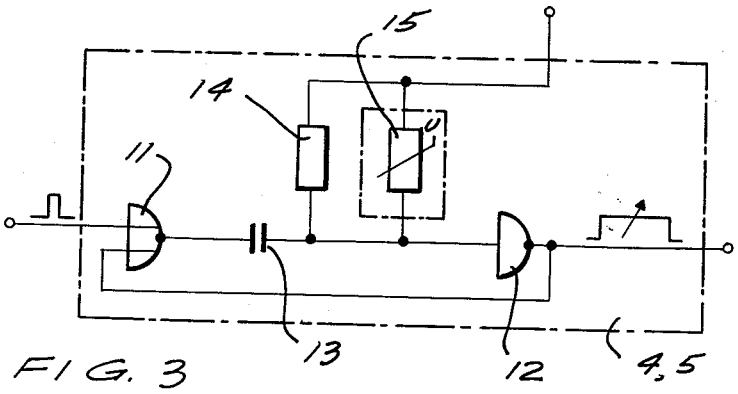
FIG. 3
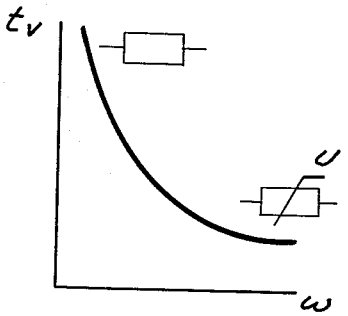
FIG. 4

CONTROL SYSTEM FOR POSITIONING UNITS EXHIBITING DEAD TIMES

BACKGROUND OF THE INVENTION

The invention relates to control systems for controlling the activation and deactivation of functional units of a printing machine, for example the throw-on and throw-off of printing cylinders, inking cylinders and other functional units.

Typically, the functional unit to be activated or deactivated is moved by a positioning unit to which the activating or deactivating signal per se is applied. However, such positioning units, such as electrohydraulic or electromagnetic or electromechanical positioning units, usually exhibit dead times in their response to activating (i.e., activating or deactivating) signals. The dead time is in part attributable to the finite time required for energization or deenergization of the electrohydraulic, electromagnetic or electromechanical positioning unit, and is in part attributable to the finite distance through which the positioning unit must move a component of the functional unit (for example, a printing cylinder from thrown-off to thrown-on position).

German Democratic Republic Pat. DL 93 784 and U.S. Pat. No. 3,818,827 discloses printing machine control systems operating on a clocked basis. For example, a sheet-representing signal is advanced through successive shift-register stages of a control shift register, under the control of clock pulses applied to the shift register by a synchronizer driven by a rotary reference component of the printing machine. The advancement of the sheet-representing signal through the successive shift-register stages simulates the travel of a sheet through the printing machine. When the sheet-representing signal reaches predetermined successive shift-register stages, functional units of the machine are activated or deactivated, e.g., printing cylinders are thrown on or off. The advancement of the sheet-representing signal from one shift-register stage to the next corresponds to predetermined increments of angular movement of the rotary reference component of the machine.

Proper synchronization can be lost if the machine is operable at a variable speed, and if the dead times of the positioning units (referred to above) are not negligible. The dead time of each positioning unit, when expressed in terms of the extent of angular movement of the rotary reference component of the printing machine, is a function of the angular velocity of the rotary reference component, i.e., of the speed of operation of the printing machine. Accordingly, synchronization based upon the angular position of the rotary reference component cannot be maintained if the speed of operation of the printing machine varies.

SUMMARY OF THE INVENTION

It is a general object of the invention to compensate for the effect of positioning-unit dead times upon proper angular synchronization of a printing machine capable of operating at variable speed.

According to the broadest concept of the invention, the effect of positioning-unit dead time upon proper synchronization is compensated for by introducing into the application of activating (i.e., activating or deactivating) signals to the positioning units a time delay which is automatically varied in dependence upon the angular velocity of the rotary reference component of the printing machine.

According to a more specific concept of the invention, a clocked control unit (for example, a sheet-travel-simulation shift register) determines when positioning units are to be activated, but variable-time-delay time-delay stages automatically vary the moments of application of activating signals to the positioning units in dependence upon the printing machine operating speed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a schematic block diagram of a second embodiment of the invention;

FIG. 3 is a circuit diagram of the variable-time-delay time-delay stages of the circuits depicted in FIGS. 1 and 2; and FIG. 4 depicts the relationship between the compensatory time delay $t_v$ and the angular velocity $w$ of a rotary reference component of the printing machine.

DESCRIPTION OF THE PREFERRED EMBODIMENTS

Figure 1:
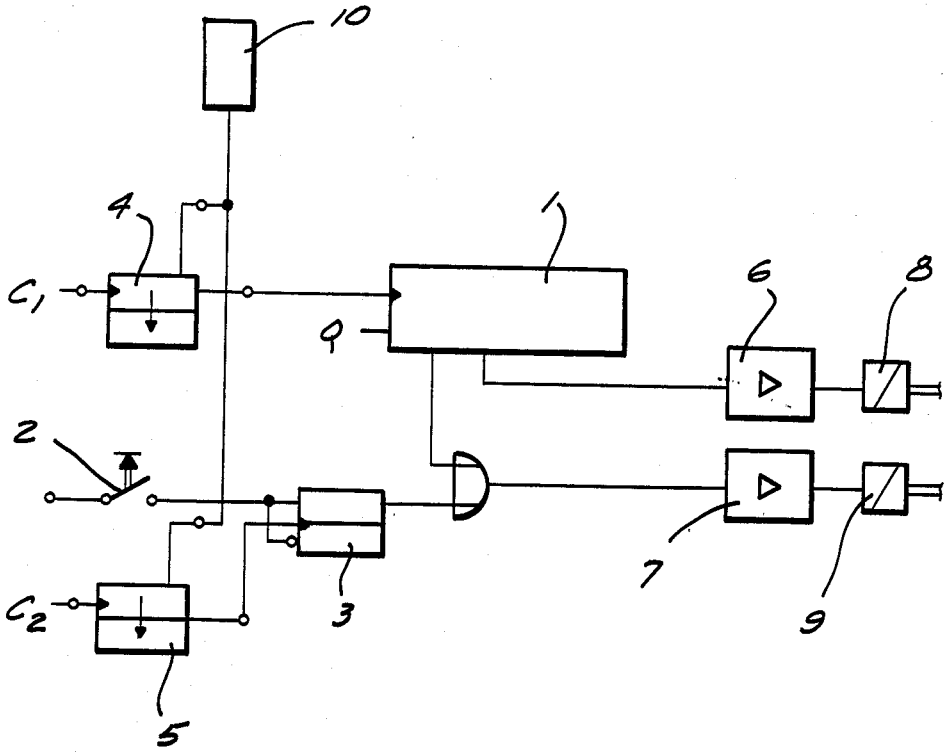
FIG. 1 is a schematic block diagram of a first embodiment of the invention.

The activating signal for a positioning unit whose response to an activating signal includes a dead time is, according to the invention, delayed in dependence upon the angular velocity of the rotary reference component of the printing machine. to compensate for the dead-time time delay; this angular-velocity-dependent time delay could alternatively be expressed in terms of advancement of the activating signal, but is discussed herein in terms of delay (retardation) of the activating signal, because a time-delay compensation expedient is being resorted to.

The angle by which the activating signal is to be deliberately delayed (i.e., the compensatory time delay expressed in terms of the extent of angular movement of the rotary reference component corresponding to the compensatory time delay at the prevailing angular velocity of the rotary reference component) is referred to herein as the delay angle. At low angular velocities of the rotary reference component, the delay angle is larger, and at higher angular velocities smaller. The relationship contemplated between the delay angle $\beta$ and the angular velocity w of the rotary reference component of the printing machine is given by the equation:

$$\beta = -aw + b$$

In this equation, $a$ is a constant dependent upon the construction and dimensions of the machine and positioning unit and upon the dead time of the positioning unit, and b is likewise a constant.

The compensatory time delay, expressed in units of time, is denoted $t_v$, and its relationship to the delay angle $\beta$ is given by the equation $$\beta = t_v \cdot w$$

Substituting from one equation to the other, one arrives at the relationship $$t_v = b/w - a$$

This equation represents a hyperbolic function for the dependence of the compensatory delay time $t_v$ upon the angular velocity $w$ of the rotary reference component of the printing machine (e.g., a printing cylinder or a rotary drive shaft).

FIG. 1 depicts a first embodiment, in which time-delay stages 4, 5 are connected to the inputs of clocked control units 1, 3. The $C_1$ and $C_2$ clock pulses which clock control units 1, 3 are delayed by the variable-time-delay time-delay stages 4, 5. The time-delay interval of the time-delay stages is dependent upon the prevailing angular velocity of the rotary reference component of the printing machine. This angular velocity is ascertained by means of unit 10 which generates an rpm-dependent voltage. The first variable-time-delay delay stage 4 delays the clock pulse $C_1$ or the first clocked control unit 1, which latter registers a signal Q associated with printing machine control, for example a printing-cylinder thrown-on signal. The first positioning unit 8 (exhibiting dead time in its response to activating signals) is activated via a first amplifier 6.

The second variable-time-delay stage 5 delays the clock pulse $C_2$ for the second clocked control unit 3, which latter is activated by an activating switch 2. Second control unit 3 or first control unit 1 activates the second positioning unit 9 (likewise exhibiting dead time in its response to activating signals) through the intermediary of a second amplifier 7.

FIG. 2 depicts another embodiment, but here the time-delay stages 4, 5 are connected to the outputs of the clocked control units 1, 3. Control of the positioning units 8, 9 is effected by clocked control units 1 and 3. Unit 1 is clocked by clock pulses $C_1$ and registers a signal Q associated with control of printing machine operation, for example a printing-cylinder throw-on signal. Unit 3 is clocked by clock pulses $C_2$ and is activated by an activating switch 2.

Connected to the outputs of clocked control units 1, 3 are first and second variable-time-delay time-delay stages 4 and 5, respectively. The time-delay interval of the delay stages 4, 5 is dependent upon the instantaneous angular velocity of the rotary reference component of the printing machine. This angular velocity is ascertained by a unit 10 which generates a rpm-dependent voltage. The first delay stage 4 activates the first positioning unit 8 (which exhibits dead time in its response) via a first amplifier 6; the second delay stage 5 activates the second positioning unit 9 (which likewise exhibits dead time in its response) via the second amplifier 7.

In these embodiments, the time-delay intervals $t_v$ afforded by delay stages 4, 5 exhibit the above-described hyperbolic relationship to the angular velocity $w$ of the rotary reference component of the printing machine.

FIG. 3 depicts the internal circuitry of the delay stages 4 and 5, which can be identical.

Each delay stage is designed as a monostable multivibrator having a variable unstable period $t_v$. The monostable multivibrator circuit includes a NOR-gate 11 whose output is connected to the input of an inverter 12, via an RC stage 13, 14. The output of inverter 12 is connected to one input of NOR-gate 11. The rpm-dependent voltage $U_{var}$ is applied to the RC stage 13, 14, at the upper terminal of resistor R.

A "0" to "1" signal transition at the input of NOR-gate 11 triggers the monostable multivibrator to its unstable state. At the input (left terminal) of capacitor 13 a logical "0" signal appears, and this signal is transmitted by the capacitor to the input of the inverter 12. This signal condition is thereafter maintained in existence, by reason of the feedback from inverter 12 to NOR-gate 11, so that if the input signal to the delay stage 4 or 5 should be removed, this will have no effect upon the duration of the unstable period of the multivibrator. Now, the capacitor 13 charges up again via resistor 14 in correspondence to the applied angular-velocity-dependent voltage $U_{var} = f(w)$. The charging-up is dependent both upon the product of the resistance and capacitance of elements 13, 14 and upon the angular-velocity-dependent voltage $U_{var}$. Upon completion of the charging, a logical "1" signal is present at the output (right terminal) of the capacitor, and is also present at the capacitor input. The monostable multivibrator accordingly reverts to its stable state.

With the linear capacitor-resistor stage 13, 14, however, only a coarse approximation to the desired hyperbolic relationship between the unstable period $t_v$ and the angular velocity $w$ can be achieved. By introducing a further time-constant-determining resistor 15 having a non-linear voltage-current relationship in parallel to resistor 14, the desired hyperbolic functional relationship can be achieved. The resistor 15 can be a conventional voltage-dependent resistor. The non-linear resistor 15 has at low voltages a considerably higher resistance than resistor 14, but at high voltages a considerably lower resistance than resistor 14. As a result, at lower angular velocities $w$ the unstable period $t_v$ is mainly determined by resistor 14, and at higher angular velocities by resistor 15.

The positioning units 8 and 9 can be electromagnetic, electromechanical, electrohydraulic or the like. They could, for example, respectively effect throw-on and throw-off of a printing cylinder, or could be associated with different components of the printing machine, e.g., a rotary multi-color multi-cylinder printing machine.

The clocked control unit 1 can be a conventional sheet-travel-simulation control shift register, as shown in FIGS. 1 and 2. In that event, the shift register 1 is composed of a plurality of successive shift-register stages. The sheet to be printed upon travels through the printing machine along a predetermined path. When the sheet to be printed enters the path, a sheet sensor applies a Q (sheet-representing) signal to the information-signal (Q signal) input of the shift register 1. As the sheet travels through the printing machine, the sheet-representing signal advances from one shift-register stage to the next, in simulation of the travel of the sheet through the printing machine. The advancement of the sheet-representing signal through the successive shift-register stages is effected by the train of clock pulses $C_1$ applied to the clock input of the shift register. These pulses are conventionally supplied by a mechanical or electromechanical synchronizer rotating in synchronism with a rotary component of the printing machine. When the sheet-representing signal reaches any particular shift-register stage, this indicates that the actual sheet has reached a corresponding point in its travel through the printing machine. In FIGS. 1 and 2, the two outputs of the shift register are the outputs of two different preselected shift-register stages. When the sheet-representing signal reaches the first of these preselected stages, unit 9 is to be activated (for example, to effect printing-cylinder throw-on); when the sheet-representing signal reaches the second of these preselected stages, unit 8 is to be activated (for example, to effect printing-cylinder throw-off).

The additional clocked control unit 3 could be provided, if desired, merely to effect manually triggered activation of positioning unit 9, for test purposes, special applications, or the like. In FIG. 2, the components 2 and 3 could be omitted, without affecting the basic operation of the circuit. In FIG. 1, switch 2 and clocked control unit 3 could be omitted, with the output of multivibrator 5 being connected directly to the input of the OR-gate.

The $C_2$ clock pulses for control unit 3 are supplied by a conventional machine synchronizer, like the one supplying clock pulses $C_1$ to shift register 1.

It will be understood that each of the elements described above, or two or more together may also find a useful application in other types of circuits and constructions differing from the types described above.

While the invention has been illustrated and described as embodied in a shift register control system, it is not intended to be limited to the details shown, since various modifications and structural changes may be made without departing in any way from the spirit of the present invention.

Without further analysis, the foregoing will so fully reveal the gist of the present invention that other can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An improved control system for a variable-speed cyclically operating printing machine, the control system being of the type including clocked control means having a clock input receiving printing-machine-synchronized clock signals, the clocked control means being operative for generating activating signals in dependence upon the number of received clock signals, the control system furthermore including at least one positioning unit connected to receive activating signals from the clocked control means but exhibiting a dead time in its response to activating signals, the duration of the dead time not varying linearly with the speed of operation of the printing machine, whereby the fraction of a printing-machine operating cycle constituted by the duration of the dead time varies as the speed of operation of the printing machine varies, the improvement comprising the provision of speed-signal generating means operative for generating a speed signal whose value varies in correspondence to the speed of operation of the printing machine; and time-delay means connected to receive the speed signal and connected to the clocked control means and operative for compensating for the varying fractional relationship between the printing-machine operating-cycle duration and the deadtime duration by introducing, into the transmission of an activating signal from the control means to the positioning unit, a compensatory time delay whose duration varies in dependence upon variations in the value of the speed signal.

2. The printing machine control system defined in claim 1, the time-delay means having input means connected to the output means of the clocked control means and having output means connected to the at least one positioning unit.

3. The printing machine control system defined in claim 1, the clocked control means having input means connected to the output means of the time-delay means and having output means connected to the at least one positioning unit.

4. The printing machine control system defined in claim 1, the clocked control means being a sheet-travel-simulation shift register.

5. The printing machine control system defined in claim 1, the time-delay means comprising a monostable multivibrator circuit including means for determining the unstable period of the multivibrator circuit and means for applying the speed signal to the determining means and causing the determining means to establish a hyperbolic relationship between the duration of the unstable period of the multivibrator circuit and the value of the speed signal.

6. The printing machine control system defined in claim 5, the determining means of the multivibrator circuit comprising resistor means having a non-linear voltage-current relationship and a constant-resistance resistor means.

7. The printing machine control system defined in claim 6, the two resistor means being connected in parallel.

* * * * *